US009685083B2

(12) United States Patent
Hahne et al.

(10) Patent No.: US 9,685,083 B2
(45) Date of Patent: Jun. 20, 2017

(54) COMPUTER PROGRAM PRODUCT AND DRIVER ASSISTANCE SYSTEM FOR A VEHICLE

(71) Applicant: GM GLOBAL TECHNOLOGY OPERATIONS LLC, Detroit, MI (US)

(72) Inventors: Uwe Hahne, Buettelborn (DE); Gerald Schmidt, Frankfurt am Main (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 371 days.

(21) Appl. No.: 14/335,584

(22) Filed: Jul. 18, 2014

(65) Prior Publication Data

US 2015/0022378 A1 Jan. 22, 2015

(30) Foreign Application Priority Data

Jul. 18, 2013 (DE) ..... 20 2013 006 466 U

(51) Int. Cl.
*G08G 1/01* (2006.01)
*G08G 1/0962* (2006.01)
*G08G 1/0967* (2006.01)

(52) U.S. Cl.
CPC ..... *G08G 1/0962* (2013.01); *G08G 1/09623* (2013.01); *G08G 1/09626* (2013.01); *G08G 1/096716* (2013.01); *G08G 1/096725* (2013.01); *G08G 1/096741* (2013.01); *G08G 1/096775* (2013.01); *G08G 1/096783* (2013.01)

(58) Field of Classification Search
CPC ..... G08G 1/092; G08G 1/09623; G08G 1/09626; G08G 1/09716; G08G 1/096725; G08G 1/096741; G08G 1/096775; G08G 1/096783
USPC ..... 340/933, 901–905
See application file for complete search history.

(56) References Cited

U.S. PATENT DOCUMENTS

| | | | | |
|---|---|---|---|---|
| 3,755,743 | A | 8/1973 | McLernon | |
| 5,485,161 | A * | 1/1996 | Vaughn | G08G 1/096725 342/357.31 |
| 2004/0225557 | A1 | 11/2004 | Phelan et al. | |
| 2009/0224942 | A1* | 9/2009 | Goudy | G08G 1/164 340/905 |
| 2010/0136944 | A1* | 6/2010 | Taylor | B60R 25/00 455/404.1 |

(Continued)

FOREIGN PATENT DOCUMENTS

| | | | |
|---|---|---|---|
| DE | 10113736 | A1 | 10/2002 |
| DE | 102005018138 | A1 | 11/2006 |

(Continued)

*Primary Examiner* — Daryl Pope
(74) *Attorney, Agent, or Firm* — Lorenz & Kopf LLP

(57) ABSTRACT

A non-transitory computer readable medium stores a computer program causing a computer to execute a process. The process includes determining traffic regulations which are applicable in a region of current surroundings of a vehicle. The process further includes determining if a driver of the vehicle violates at least one of the determined traffic regulations and determining a degree of severity of a violation. The process further includes determining a parameter illustrating a driving behavior of the driver of the vehicle based on the classified degree of severity of the violation. A message is then output including the determined parameter with at least one output device.

16 Claims, 6 Drawing Sheets

(56) References Cited

U.S. PATENT DOCUMENTS

| | | | | |
|---|---|---|---|---|
| 2010/0207787 | A1* | 8/2010 | Catten | G06F 17/30241 340/905 |
| 2011/0254655 | A1 | 10/2011 | Maalouf et al. | |
| 2012/0109451 | A1* | 5/2012 | Tan | G01C 21/3664 701/36 |
| 2012/0307064 | A1* | 12/2012 | Schenken | G08G 1/0175 348/149 |

FOREIGN PATENT DOCUMENTS

| | | | |
|---|---|---|---|
| DE | 102010043696 | A1 | 5/2012 |
| EP | 1975899 | A1 | 10/2008 |

* cited by examiner

COMPUTER PROGRAM PRODUCT AND DRIVER ASSISTANCE SYSTEM FOR A VEHICLE

CROSS REFERENCE TO RELATED APPLICATION

This application claims priority to German Patent Application No. 202013006466.8 filed Jul. 18, 2013, which is incorporated herein by reference in its entirety.

TECHNICAL FIELD

The technical field relates to a computer program product, a driver assistance system for a vehicle, and a computer-readable medium.

BACKGROUND

From DE 10 2010 043 696 A1, a method for informing a driver of a motor vehicle in a road traffic network, which comprises regions with different traffic rules, is known. The method comprises steps of determining one of the regions as home region, of determining that a current region, in which the motor vehicle is located, differs from the home region, of detecting the existence of a traffic situation in which an associated traffic rule in the current region differs from a traffic rule associated with the same traffic situation in the home region, and of outputting a traffic instruction in order to comply with the traffic rule in the current region.

SUMMARY

The object of embodiments of the invention is to state a computer program product, a driver assistance system for a vehicle and a computer-readable medium, which make possible a further improvement of driving safety.

According to an aspect of the invention, a computer program product is stated which, when it is executed on a computer unit, instructs the computer unit to carry out the following steps:

- determining of traffic regulations applicable in a region of a current surroundings of a vehicle,
- determining if a driver of the vehicle violates at least one of the determined traffic regulations,
- in the case that it is determined that the driver of the vehicle violates at least one of the determined traffic regulations, classifying of a degree of severity of the violation based on a plurality of predetermined degrees of severity,
- determining of a parameter characterizing a driving behavior of the driver of the vehicle based on the classified degree of severity of the violation,
- outputting a message containing the determined parameter by means of at least one output device.

Here, a traffic regulation is to mean a regulation or rule to be complied with by road users. Traffic regulations can be established in particular through sovereign requirements, for example in the form of laws or regulations.

The computer program product according to the mentioned embodiment makes possible a further improvement of the driving safety. This is effected in particular through the classifying of a degree of severity of a determined violation of at least one of the determined traffic regulations by the driver of the vehicle, the determining of a parameter characterizing a driving behavior of the driver of the vehicle based on the classified degree of severity of the violation and the outputting of a message containing the determined parameter. By means of this, the driver of the vehicle can be provided in particular while driving the vehicle information regarding its current driving behavior with respect to adhering to traffic regulations. By means of this the driver can adapt his driving behavior in a further improved manner so that the applicable traffic regulations are adhered to.

In an embodiment of the computer program product the determining of the traffic regulations applicable in a region of the current surroundings of the vehicle includes a determining of a current position of the vehicle by means of a position determining device and accessing data stored in a storage device regarding traffic regulations applicable in a region of the determined current position of the vehicle. By means of this, traffic regulations which are applicable in the region of the determined position of the vehicle can be determined in a simple manner.

Accessing data stored in the storage device can in particular include accessing data stored in a vehicle-external storage device and/or in a navigation system regarding traffic regulations applicable in a region of the determined current position of the vehicle. Such storage devices or navigation systems typically include map data, in which applicable traffic regulations are stored as well.

In a further embodiment of the computer program product, the determining of the traffic regulations which are applicable in a region of the current surroundings of the vehicle includes a determining of traffic regulations which are applicable in a region of the current surroundings of the vehicle based on data determined by at least one first sensor of the vehicle. The at least one first sensor can for example be designed as an optical camera. By means of this, traffic regulations which are applicable in the region of the determined position of the vehicle can be advantageously determined which are for not stored in the map data of a navigation system or which were changed for example because of a current traffic situation, in particular because of a construction site situation.

In a further embodiment of the computer program product the determining of the traffic regulations which are applicable in a region of the current surroundings of the vehicle includes determining of traffic regulations which are applicable in a region of the current surroundings of the vehicle based on data received from at least one communication unit of the vehicle. The at least one communication unit in this case is selected for example from the group consisting of a radio receiver unit, a mobile radio receiver unit, a vehicle-to-vehicle communication unit and a vehicle-to-infrastructure communication unit. The two last-mentioned communication units in this case are also called car-to-car (C2C) or vehicle-to-vehicle (V2V) communication or car-to-infrastructure (C2I) or vehicle-to-roadside (V2R) communication or in summary as car-to-x (C2X) or vehicle-to-x (V2X) communication.

In a further embodiment of the computer program product, the determining of the traffic regulations which are applicable in a region of the current surroundings of the vehicle includes determining of country-specific regulations applicable in the region of the current surroundings of the vehicle. By means of this, the driver of the vehicle can be advantageously provided with information regarding country-specific traffic regulations, i.e. traffic regulation the validity of which can change from country to country, and with which the driver of the vehicle if applicable is therefore not familiar.

In a further embodiment of the computer program product the determining if the driver of the vehicle violates at least one of the determined traffic regulations takes placed based on data determined by at least one second sensor of the vehicle. The at least one second sensor of the vehicle can in particular be designed as a speed sensor. Furthermore, the at least one second sensor can be designed for example as an optical camera. By means of this it can be determined in a simple manner if the driver of the vehicle violates at least one of the determined traffic regulations.

In a further embodiment of the computer program product determining if the driver of the vehicle violates at least one of the determined traffic regulations includes determining if the driver of the vehicle violates a speed limit, a right of way situation, no overtaking and/or a minimum distance command to a further vehicle. Adhering to the mentioned traffic regulations is relevant to road safety to a particular degree.

In a further embodiment of the computer program product the computer unit is additionally instructed to carry out the following steps:

determining if there is a user requirement for outputting a parameter characterizing the driving behavior of the driver, wherein outputting of the message containing the determined parameter by means of the at least one output device takes place in the case that it is determined that there is a user requirement for outputting the parameter characterizing the driving behavior of the driver.

By means of this, the information regarding the driving behavior of the driver can be advantageously output merely in the cases in which that this is requested by the driver of the vehicle.

In the case that it is determined that the driver of the vehicle violates at least one of the determined traffic regulations, the computer unit in a further embodiment of the computer program product is additionally instructed to carry out the following steps:

determining a frequency with which the driver of the vehicle violates determined traffic regulations, determining if the determined frequency exceeds a first predetermined threshold value, in the case that it is determined that the determined frequency exceeds the first predetermined threshold value, limiting of a current power consumption of a drive engine of the vehicle and/or of a current speed of the vehicle.

By means of this, further possible violations of traffic regulations can be prevented to a further improved degree.

In the case that it is determined that the driver of the vehicle violates at least one of the determined traffic regulations, the computer unit is additionally instructed in a further embodiment of the computer program product to carry out the following steps:

determining a type of the traffic regulation which is violated by the driver of the vehicle based on a plurality of predetermined types of traffic regulations, determining a frequency with which the driver of the vehicle violates the determined type of the traffic regulation.

By means of this, the type and frequency of violations of traffic regulations can be determined to a further improved degree.

In a further embodiment of the computer program product the computer unit is additionally instructed to carry out the following steps:

determining if the determined frequency exceeds a second predetermined threshold value, in the case that it is determined that the determined frequency exceeds the second predetermined threshold value, outputting of a message containing the determined type of the traffic regulation and/or the determined frequency by means of the at least one output device By means of this, the driver can be advised of the determined type of the violation or the determined frequency of violations of certain traffic regulations.

In a further embodiment of the computer program product the computer unit is additionally instructed to carry out the following steps:

determining if the determined frequency exceeds a third predetermined threshold value, in the case that it is determined that the determined frequency exceeds the third predetermined threshold value, adapting at least one operating parameter of at least one driver assistance system of the vehicle.

By means of this, driving safety can be advantageously further improved in that for example a triggering threshold of the at least one driver assistance system is adapted when the third predetermined threshold value is exceeded in such a manner that the driver assistance system outputs or performs an autonomous intervention in the driving dynamics of the vehicle at an earlier time. Furthermore, adapting the at least one operating parameter can include outputting an additional warning message.

A further aspect of the invention relates to a driver assistance system for a vehicle, wherein the driver assistance system comprises at least one output device, a computer unit and a computer program product according to any one of the mentioned embodiments.

The driver assistance system according to the mentioned embodiment has the advantages already mentioned in connection with the relevant computer program product which are not mentioned again at this point to avoid repetitions.

In addition to this, a further aspect of the invention relates to a computer-readable medium on which a computer program product according to one of the mentioned embodiments is stored.

The computer-readable medium according to the mentioned embodiment comprises the advantages already mentioned in connection with the relevant computer program product which are not mentioned again at this point to avoid repetitions.

The vehicle is for example a motor vehicle, in particular a passenger car or a utility vehicle. A further aspect of the inventions relates to a method for operating a driver assistance system for a vehicle, wherein the method comprises the following steps:

determining of traffic regulations applicable in a region of current surroundings of a vehicle, determining if a driver of the vehicle violates at least one of the determined traffic regulations, in the case that it is determined that the driver of the vehicle violates at least one of the determined traffic regulations, classifying of a degree of severity of the violation based on a plurality of predetermined degrees of severity, determining of a parameter characterizing a driving behavior of the driver of the vehicle based on the classified degree of severity of the violation, outputting a message containing the determined parameter by means of at least one output device.

The method according to the mentioned embodiment has the advantages already mentioned in connection with the relevant computer program product, which are not mentioned again at this point to avoid repetitions.

In an embodiment of the method, the determining of the traffic regulations which are applicable in a region of the current surroundings of the vehicle includes a determining of a current position of the vehicle by means of a position determining device and accessing of data stored in a storage device regarding traffic regulations which are applicable in a region of the determined current position of the vehicle.

Accessing the data stored in the storage device can in particular include accessing data stored in a vehicle-external storage device and/or in a navigation system regarding traffic regulations which are applicable in a region of the determined current position of the vehicle.

In a further embodiment of the method, determining the traffic regulations which are applicable in a region of the current surroundings of the vehicle includes determining of traffic regulations which are applicable in a region of the current surroundings of the vehicle based on data determined by at least one first sensor of the vehicle.

In a further embodiment of the method, determining the traffic regulations which are applicable in a region of the current surroundings of the vehicle includes determining of traffic regulations applicable in a region of the current surroundings of the vehicle based on data received from at least one communication unit of the vehicle. The at least one communication unit in this case is selected for example from the group consisting of a radio receiver unit, a mobile radio receiver unit, a vehicle-to-vehicle communication unit and a vehicle to infrastructure communication unit.

In a further embodiment of the method, determining the traffic regulations which are applicable in a region of the current surroundings of the vehicle includes determining of country-specific regulations which are applicable in the region of the current surroundings of the vehicle.

In a further embodiment of the method, determining if the driver of the vehicle violates at least one of the determined traffic regulations takes place based on data determined by at least one second sensor of the vehicle.

In a further embodiment of the method, determining if the driver of the vehicle violates at least one of the determined regulations includes determining if the driver of the vehicle violates a speed limit, a right of way situation, no overtaking and/or a minimum distance command to a further vehicle.

In a further embodiment of the method, the following steps are additionally carried out, determining if there is a user request for outputting a parameter characterizing the driving behavior of the driver, wherein the outputting of the message containing the determined parameter takes place by means of the at least one output device in the case that it is determined that there is a user request for outputting the parameter characterizing the driving behavior of the driver.

In the case that it is determined that the driver of the vehicle violates at least one of the determined traffic regulations the following steps are additionally carried out in a second embodiment of the method:

determining a frequency with which the driver of the vehicle violates determined traffic regulations, determining if the determined frequency exceeds a first predetermined threshold value, in the case that it is determined that the determined frequency exceeds the first predetermined threshold value, limiting a current power consumption of a drive engine of the vehicle and/or a current speed of the vehicle.

In the case that it is determined that the driver of the vehicle violates at least one of the determined traffic regulations, the following steps are additionally carried out in a further embodiment of the method:

determining a type of the traffic regulation which is violated by the driver of the vehicle, based on a plurality of predetermined types of traffic regulations, determining a frequency with which the driver of the vehicle violates the determined type of traffic regulation.

In a further embodiment of the method, the following steps are additionally carried out:

determining if the determined frequency exceeds a second predetermined threshold value, in the case that it is determined that the determined frequency exceeds the second predetermined threshold value, outputting a message containing the determined type of the traffic regulation and/or the determined frequency by means of the at least one output device.

In a further embodiment of the method, the following steps are additionally carried out:

determining if the determined frequency exceeds a third predetermined threshold value, in the case that it is determined that the determined frequency exceeds the third predetermined threshold value, adapting at least one operating parameter of at least one driver assistance system of the vehicle.

Furthermore, a further aspect of the invention relates to a device for operating a driver assistance system for a vehicle, comprising:

means for determining traffic regulations which are applicable in a region of a current surroundings of a vehicle, means for determining if a driver of the vehicle violates at least one of the determined traffic regulations, means for classifying a degree of severity of the violation based on a plurality of predetermined degrees of severity in the case that it is determined that the driver of the vehicle violates at least one of the determined traffic regulations, means for determining a parameter characterizing a driving behavior of the driver based on the classified degree of severity of the violation, means for outputting a message containing the determined parameter by means of at least one output device.

By means of the mentioned device for operating a driver assistance system for a vehicle, further improvement of the driving safety, as already explained, is made possible.

In an embodiment of the device for operating a driver assistance system, the means for determining the traffic regulations which are applicable in a region of the current surroundings of the vehicle include means for determining a current position of the vehicle by means of a position determining device and means for accessing data stored in a storage device regarding traffic regulations which are applicable in a region of the determined current position of the vehicle. By means of this, traffic regulations which are applicable in the region of the determined position of the vehicle can be determined in a simple manner.

The accessing of the data stored in the storage device can in particular include accessing data stored in a vehicle-external storage device and/or in a navigation system regarding traffic regulations which are applicable in a region of the determined current position of the vehicle. Such storage devices or navigation systems typically contain map data, in which applicable traffic regulations are stored as well.

In a further embodiment of the device for operating a driver assistance system, the means for determining the traffic regulations which are applicable in a region of the current surroundings of the vehicle include means for determining traffic regulations which are applicable in a region of the current surroundings based on data determined by at least one first sensor of the vehicle. The at least one first sensor can for example be designed as an optical camera. By means of this, traffic regulations which are applicable in the region of the determined position of the vehicle can be advantageously determined, which for example are not stored in the map data of a navigation system or which were changed for example based on a current traffic situation, in particular because of a construction site situation.

In a further embodiment of the device for operating a driver assistance system, the means for determining the traffic regulations which are applicable in the region of the current surroundings of the vehicle include means for determining traffic regulations which are applicable in a region of the current surroundings of the vehicle based on data received from at least one communication unit of the vehicle. The at least one communication unit in this case is selected for example from the group consisting of a radio receiver unit, a mobile radio receiver unit, a vehicle-to-vehicle communication unit and a vehicle-to-infrastructure communication unit.

In a further embodiment of the device for operating a driver assistance system, the means for determining the traffic regulations which are applicable in a region of the current surroundings of the vehicle include means for determining country-specific regulations which are applicable in the region of the current surroundings of the vehicle. By means of this, the driver of the vehicle can be advantageously provided with information regarding country-specific traffic regulations, i.e. traffic regulations the validity of which can change from country to country and with which if applicable the driver of the vehicle is therefore not familiar.

In a further embodiment of the device, determining if the driver of the vehicle violates at least one of the determined traffic regulations takes place based on data determined by at least one second sensor of the vehicle. The at least one second sensor of the vehicle can be designed in particular as a speed sensor. Furthermore, the at least one second sensor can be designed as an optical camera for example. By means of this it can be determined in an easy manner if the driver of the vehicle violates at least one of the determined traffic regulations.

In a further embodiment of the device for operating a driver assistance system, the means for determining if the driver of the vehicle violates at least one of the determined traffic regulations include means for determining if the driver of the vehicle violates a speed limit, a right of way situation, no overtaking and/or a minimum distance command to a further vehicle. Adhering to the mentioned traffic regulations is particularly relevant to traffic safety.

In a further embodiment, the device additionally comprises the following:

- means for determining if there is a user requirement for outputting a parameter characterizing the driving behavior of the driver,
- wherein outputting of the message containing the determined parameter by means of the at least one output device takes place in the case that it is determined that there is a user request for outputting the parameter characterizing the driving behavior of the driver.

By means of this, the information regarding the driving behavior of the driver can be advantageously output merely in the cases in which this is desired by the driver of the vehicle.

In a further embodiment, the device additionally comprises the following:

- means for determining a frequency with which the driver of the vehicle violates determined traffic regulations,
- means for determining if the determined frequency exceeds a first predetermined threshold value,
- means for limiting a current power consumption of a driver engine of the vehicle and/or of a current speed of the vehicle in the case that it is determined that the determined frequency exceeds the first predetermined threshold value.

By means of this, further possible violations of traffic regulations can be prevented to a further improved degree.

In a further embodiment, the device additionally comprises the following:

- means for determining a type of the traffic regulation which is violated by the driver of the vehicle based on a plurality of predetermined types of traffic regulations,
- means for determining a frequency with which the driver of the vehicle violates the determined type of the traffic regulation.

By means of this, the type and frequency of violations of traffic regulations can be determined to a further improved degree.

In a further embodiment, the device additionally comprises the following:

- means for determining if the determined frequency exceeds a second predetermined threshold value,
- means for outputting a message including the determined type of the traffic regulation and/or the determined frequency by means of the at least one output device in the case that it is determined that the determined frequency exceeds the second predetermined threshold value.

By means of this, the driver can be informed of the determined type of the violation or the determined frequency of violations of certain traffic regulations.

In a further embodiment, the device additionally comprises the following:

- means for determining if the determined frequency exceeds a third predetermined threshold value,
- means for adapting at least one operating parameter at least of a driver assistance system of the vehicle in the case that it is determined that the determined frequency exceeds the third predetermined threshold value.

By means of this, the driving safety can be advantageously improved in that for example a triggering threshold of the at least one driver assistance system is adapted when the third predetermined threshold value is exceeded in such a manner that the driver assistance system outputs a warning message at an earlier time or performs an autonomous intervention in the driving dynamics of the vehicle. Furthermore, adapting the at least one operating parameter can include outputting an additional warning message.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
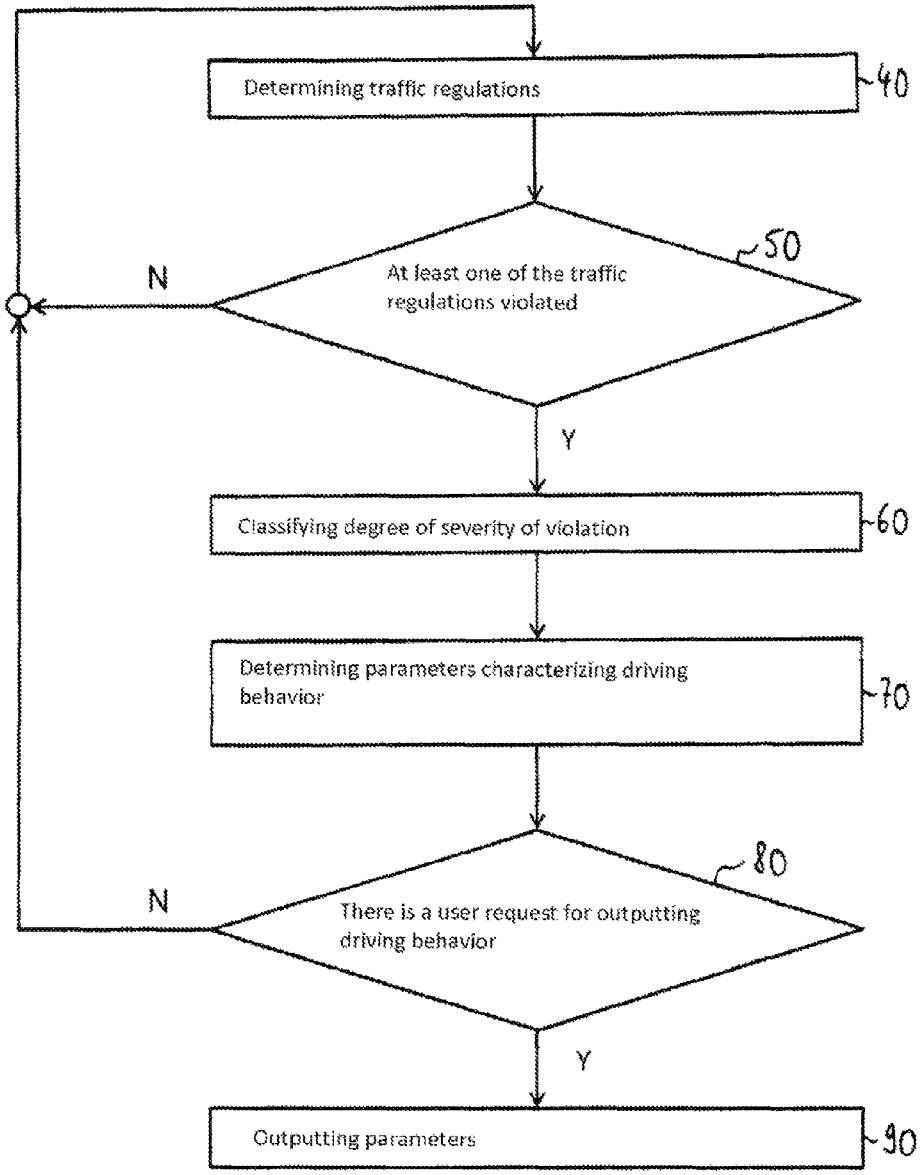
FIG. 1 shows a flow diagram of a method which is carried out by means of a computer unit according to a first embodiment.

FIG. 1 shows a flow diagram of a method according to a first embodiment, which is carried out by means of a computer unit, when a computer program product according to one of the abovementioned embodiments is executed on the computer unit.

Determining of traffic regulations or traffic rules which are applicable in a region of current surroundings takes place while a vehicle is operated in a step 40.

Determining the traffic regulations in this case can include determining a current position of the vehicle by means of a position determining device and accessing data stored in a storage device regarding traffic regulations which are applicable in a region of the determined current position of the vehicle, in particular accessing data stored in a vehicle-external storage device and/or in a navigation system regarding traffic regulations which are applicable in a region of the determined current position of the vehicle.

Furthermore, determining the traffic regulations can include determining traffic regulations which are applicable in a region of the current surroundings of the vehicle based on data determined by at least one first sensor of the vehicle. For example, traffic regulations which are applicable in a region of the current surroundings of the vehicle can be determined based on data determined by at least one optical camera of the vehicle.

Furthermore, determining the traffic regulations which are applicable in a region of the current surroundings of the vehicle can include determining traffic regulations which are applicable in a region of the current surroundings of the vehicle based on data received from at least one communication unit of the vehicle. The at least one communication unit in this case is selected for example from the group consisting of a radio receiver unit, a mobile radio receiver unit, a vehicle-to-vehicle communication unit and a vehicle-to-infrastructure communication unit.

Determining the traffic regulations can additionally include determining country-specific regulations which are applicable in the region of the current surroundings of the vehicle. By means of this, the driver of the vehicle can be provided with information regarding country-specific regulations, i.e. traffic regulations the validity of which can change from country to country and with which the driver of the vehicle if applicable is therefore not familiar.

Determining if the driver of the vehicle violates at least one of the traffic regulations determined in the step 40, for example based on data determined by at least one second sensor of the vehicle, takes place in a step 50. The at least one second sensor of the vehicle to this end can be designed as an optical camera, while the driver of the vehicle is at least partly located within its sensing range. By means of this it can be determined for example if the driver of the vehicle looks over his shoulder as prescribed during a lane change. Furthermore, the at least one second sensor of the vehicle can be designed as a speed sensor. By means of this, a possible violation of a speed limit or speed restriction which is applicable in the region of the current surroundings of the vehicle can be determined.

In the case that it is determined in the step 50 that the driver of the vehicle does not violate the determined traffic regulations, i.e. in the case that it is determined in the step 50 that the driver of the vehicle adheres to or observes all of the determined traffic regulations the steps 40 and 50 are carried out repeatedly. If applicable, this can be repeated for a predetermined period of time or a predetermined distance covered and, in the case that the driver of the vehicle adheres to all of the determined traffic regulations during the predetermined period of time or the predetermined distance covered, a message be output by means of at least one output device, for example by means of at least one visual and/or acoustic output device of the vehicle which informs the driver of the vehicle of the traffic rule-compliant driving behavior. By means of this, the driver of the vehicle can be praised for the traffic rule-compliant driving behavior.

In the case, by contrast, that it is determined in the step 50 that the driver of the vehicle violates at least one of the determined traffic regulations a classifying of a degree of severity of the violation based on a plurality of predetermined degrees of severity takes place in a step 60. The plurality of predetermined degrees of severity in this case can correspond to a sovereign predetermined system, for example the point system of the Road Traffic Act.

In a step 70, determining of a parameter characterizing a driving behavior of the driver of the vehicle based on the degree of severity of the violation classified in the step 60 takes place in a step 70. For example, a numerical value within a points list or a scale is determined, wherein a numerical value of 100 points characterizes a completely traffic-compliant driving behavior of the driver and for determined violations points are deducted, wherein the amount of points deduction is determined as a function of the determined degree of severity of the violation.

In the shown embodiment, determining if there is a user request for outputting the parameter characterizing the driving behavior of the driver additionally takes place in a step 80. If it is determined for example if a relevant operating element is actuated or a menu setting is selected in such a manner that the outputting of the parameter is requested.

If it is determined in the step 80 that there is no user request for outputting the parameter characterizing the driving behavior of the driver the steps 40 and 50 as well as if applicable 60, 70 and 80 are carried out repeatedly.

If by contrast it is determined in the step 80 that there is a user request for outputting the parameter characterizing the driving behavior of the driver, outputting of the message containing the determined parameter by means of the at least one output device takes place in a step 90.

The determined parameter can be additionally stored in a storage device. In particular, the determined parameter in this case can be assigned to a respective current driver of the vehicle. Thus, a personalization of the parameter characterizing the driving behavior of the driver of the vehicle can take place.

Figure 2:
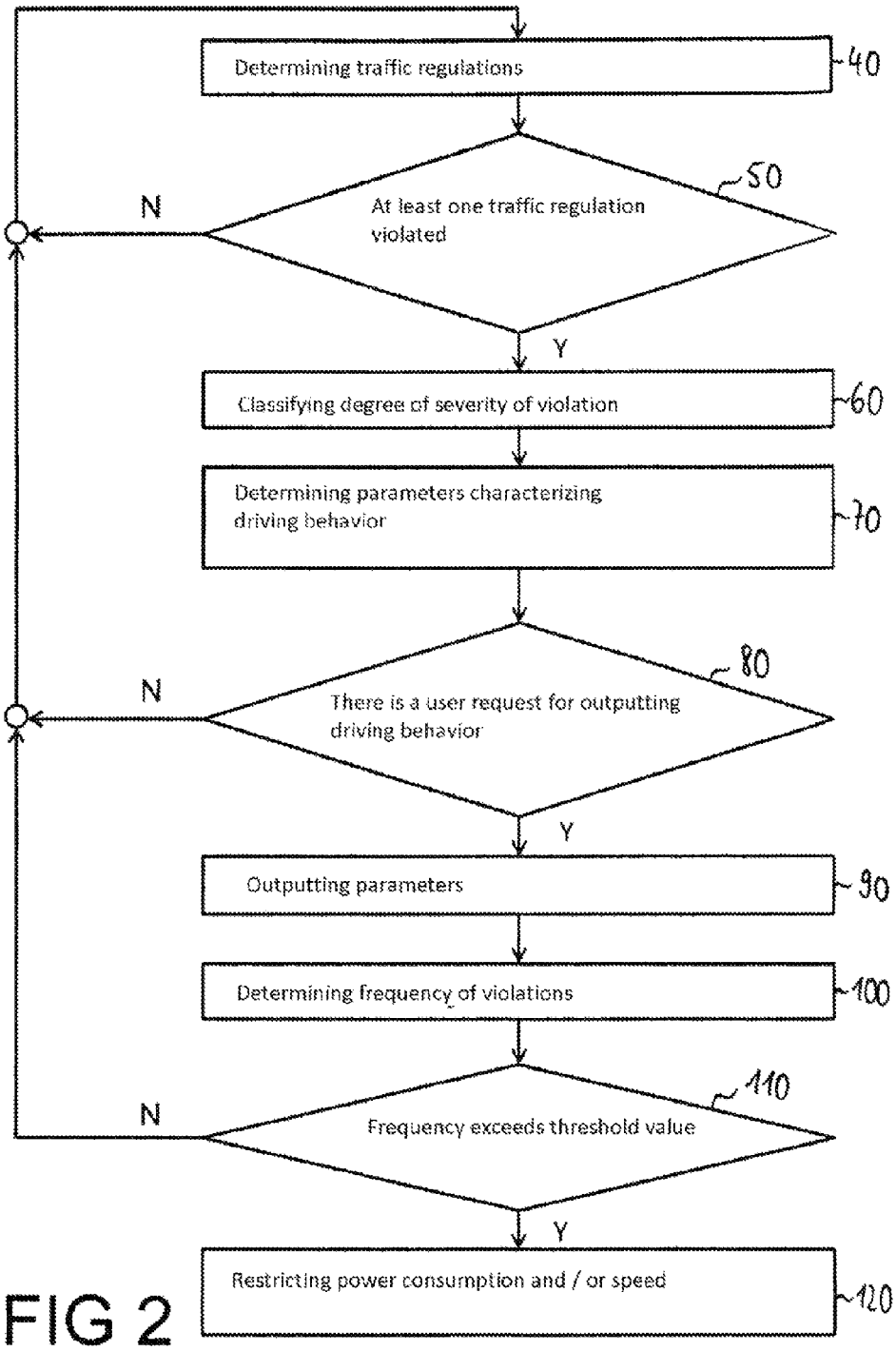
FIG. 2 shows a flow diagram of a method which is carried out by means of a computer unit according to a second embodiment.

FIG. 2 shows a flow diagram of a method according to a second embodiment, which is carried out by means of a computer unit when a computer program product according to one of the abovementioned embodiments is executed on the computer unit.

The steps 40 to 90 of the second embodiment shown in FIG. 2 in this case corresponds to the steps 40 to 90 of the first embodiment shown in FIG. 1 and are not mentioned again to avoid repetitions.

In a step 100, a frequency with which the driver of the vehicle violates determined traffic regulations is determined in the second embodiment in a step 100. It is determined for example how frequently the driver of the vehicle violates determined traffic regulations within a predetermined period of time or a predetermined distance covered.

In a step 110, it is determined if the determined frequency exceeds a first predetermined threshold value.

In the case that it is determined in the step 110 that the determined frequency does not exceed the first predetermined threshold value, the steps 40 and 50 as well as if applicable 60, 70, 80, 90, 100 and 110 are carried out repeatedly.

In the case, by contrast, that it is determined in the step 110 that the determined frequency exceeds the first predetermined threshold value, a current power consumption of a drive engine of the drive vehicle and/or a current speed of the vehicle is limited in a step 110, for example by means of a speed limiting system of the vehicle.

Figure 3:
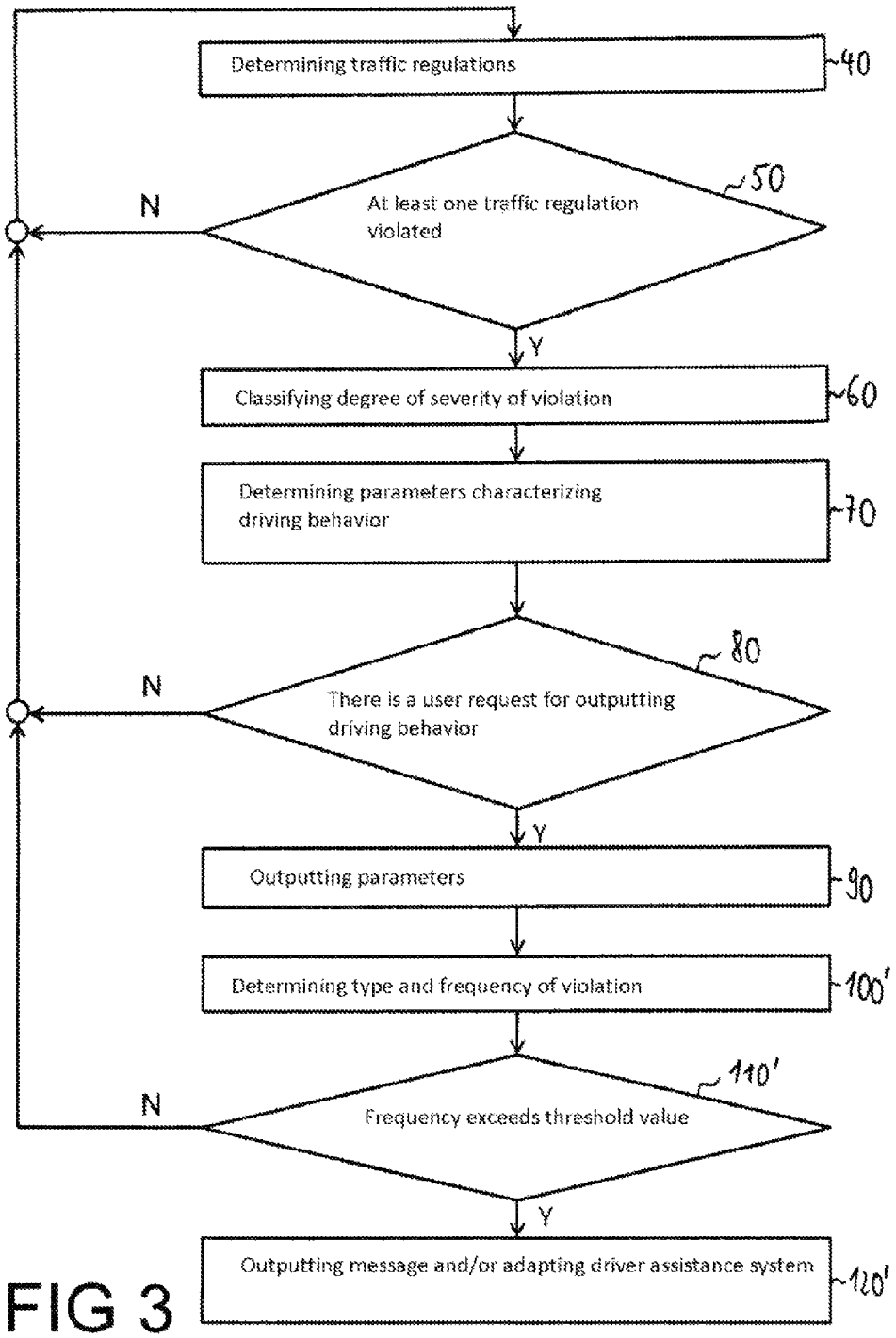
FIG. 3 shows a flow diagram of a method which is carried out by means of a computer unit according to a third embodiment.

FIG. 3 shows a flow diagram of a method according to a third embodiment, which is carried out by means of a computer unit when a computer program product according to one of the abovementioned embodiments is executed on the computer unit.

The steps 40 to 90 of the third embodiment shown in FIG. 3 in this case correspond to the steps 40 to 90 of the first embodiment shown in FIG. 1 and are not mentioned again in order to avoid repetitions.

In a step 100', a type of the traffic regulation which is violated by the driver of the vehicle is determined in the third embodiment based on a plurality of predetermined types of traffic regulations. The plurality of predetermined types of traffic regulations can in this case correspond to a sovereign predetermined system, for example traffic regulations or traffic rules of the Road Traffic Act.

Furthermore, a frequency with which the driver of the vehicle violates the determined type of traffic regulation is determined in the step 100'. For example it is determined how frequently the driver of the vehicle violates the determined type of traffic regulation within a predetermined period of time or a predetermined distance covered.

In a step 110' it is determined if the determined frequency exceeds a second or a third predetermined threshold value.

In the case that it is determined in the step 110' that the determined frequency does not exceed any of the two predetermined threshold values, the steps 40 and 50 and if applicable 60, 70, 80, 90, 100' and 110' are carried out repeatedly.

In the case that it is determined in the step 110' that the determined frequency exceeds the second predetermined threshold value, outputting of a message containing the determined type of the traffic regulation and/or the determined frequency takes place in a step 120' by means of the at least one output device. By means of this the driver can be informed of the determined type of the violation or the determined frequency of violations of certain traffic regulations.

The outputting of the message in this case can take place directly following the determining that the determined frequency exceeds the second predetermined threshold value.

Furthermore, outputting the message can take place additionally or alternatively in the case that it is determined that the vehicle is again in a traffic situation which is similar or corresponds to the traffic situation in which the driver of the vehicle violated the determined type of traffic regulation or that such a traffic situation is again imminent. For example, when on leaving a traffic circle indicating, i.e. actuating the driving direction indicator, was forgotten, the message can be output even before driving into a new traffic circle in particular in the form of a message "on leaving the traffic circle do not forget to indicate". Furthermore, when during a lane change the looking over the shoulder was forgotten, the message can be output even upon a subsequent activating of the indicator.

The second predetermined threshold value can be set in particular in such a manner that outputting the message takes place even after a one-off violation of the determined type of traffic regulation.

Furthermore, the second predetermined threshold value can be configurable by the user of the vehicle, for example the driver of the vehicle. In particular, the second predetermined threshold value can be different or differently configurable for different types of traffic regulations. Thus, outputting of the message can take place for different types of traffic regulations when different frequencies are exceeded.

In addition, the user of the vehicle can configure in a further configuration the type of traffic regulations for which outputting of a message containing the determined type of the traffic regulation and/or the determined frequency is to take place and for which types of traffic regulations this is to be omitted.

Furthermore, the owner of the vehicle can for example set the driver of the vehicle for whom outputting of a message including the type of traffic regulation and/or the determined frequency is to take place and for which types of traffic regulations this is to take place or be omitted. For example, the owner of the vehicle can adjust that for certain drivers outputting of a message containing the determined type of traffic regulation and/or the determined frequency is to take place for all types of traffic regulations. A change of the adjustments made can for example be merely effected by the owner of the vehicle, by way of which it can be advantageously achieved that in particular young drivers cannot make any changes to the adjustments made.

In the case that it is determined in the step 110' that the determined frequency exceeds the third predetermined threshold value, adapting of at least one operating parameter of at least one driver assistance system of the vehicle takes place in the step 120'. For example, a triggering threshold of the at least one driver assistance system is adapted when the third predetermined threshold value is exceeded in such a manner that the driver assistance system outputs a warning message or performs an autonomous intervention in the driving dynamics of the vehicle at an earlier time. The third predetermined threshold value in this case can correspond to the second predetermined threshold value or be different from it. In particular, the third predetermined threshold value can be greater than the second predetermined threshold value.

By means of the shown embodiments, the driver of the vehicle can be provided with information which helps him to comply with the traffic regulations. Furthermore, parents of young drivers can also monitor for example if the vehicle is operated in keeping with traffic regulations.

In the process, a driver assistance system in a configuration determines by means of data for example of a digital map and environmental sensors such as camera, radar and ultrasound sensors all applicable traffic rules at any time which have to be adhered to for duly participating in the road traffic for example according to StVO (German Road Traffic Act). This takes place for example with respect to the subject of right of way regulation, speed limit, driving over lane markings, necessary indicator activation, distances to vehicle ahead, overtaking on right hand side and parking.

Adhering to these traffic rules is compared with the driving behavior of the driver for example by means of internal vehicle data and viewing direction information.

The system in this case acts as a "virtual driving instructor" or "car driver coach", which in a configuration provides the driver with information as to whether and especially how well said driver observes or violates right of way regulations, speed regulations etc. at present. This can be effected for example in the form of a score list, i.e. the driver receives the full number of points for behavior which is 100% in keeping with traffic regulations. Deductions of the points are made for violations dependent on the severity. However it is also rated when the driver for example drives in a manner obstructing traffic and even endangering traffic.

It is possible furthermore depending on the number of points of the driving instructor system to show the driver additional information. For example, if the driver fails to indicate for frequently when leaving traffic circles information in this regard can be provided to the effect that this is normally required according to StVO.

In a further configuration, the system when abroad automatically adapts to country-specific traffic rules so that especially unknown traffic rules abroad can be brought to the attention of the driver more rapidly.

It is possible furthermore to determine, in particular as the owner of the vehicle, that the vehicle performance is limited in the case of more frequent disregarding of traffic rules and receives less power when the driver violates the traffic rules more frequently. Thus, parents of youths can for example determine that their juvenile drivers are given a limitation of the maximum speed and output of the engine or a sports mode is no longer usable.

It is also possible to change certain safety systems with respect to their calibration. For example, a distance warning system, which normally only warns via display can additionally draw attention to the insufficient distance with warning sounds when driving up too closely more frequently.

The driver has thus been shown how well he complies with the StVO. With the help of the so-called "virtual driving instructor" or "vehicle coach system" the driver can request at any time to be shown the defects his driving style has when viewed objectively.

For parents, the mentioned embodiments have the advantage that they can monitor how the vehicle is utilized and thereby establish safeguards in order to stop a driving style especially with juvenile drivers that is not in keeping with traffic regulations.

Figure 4A:
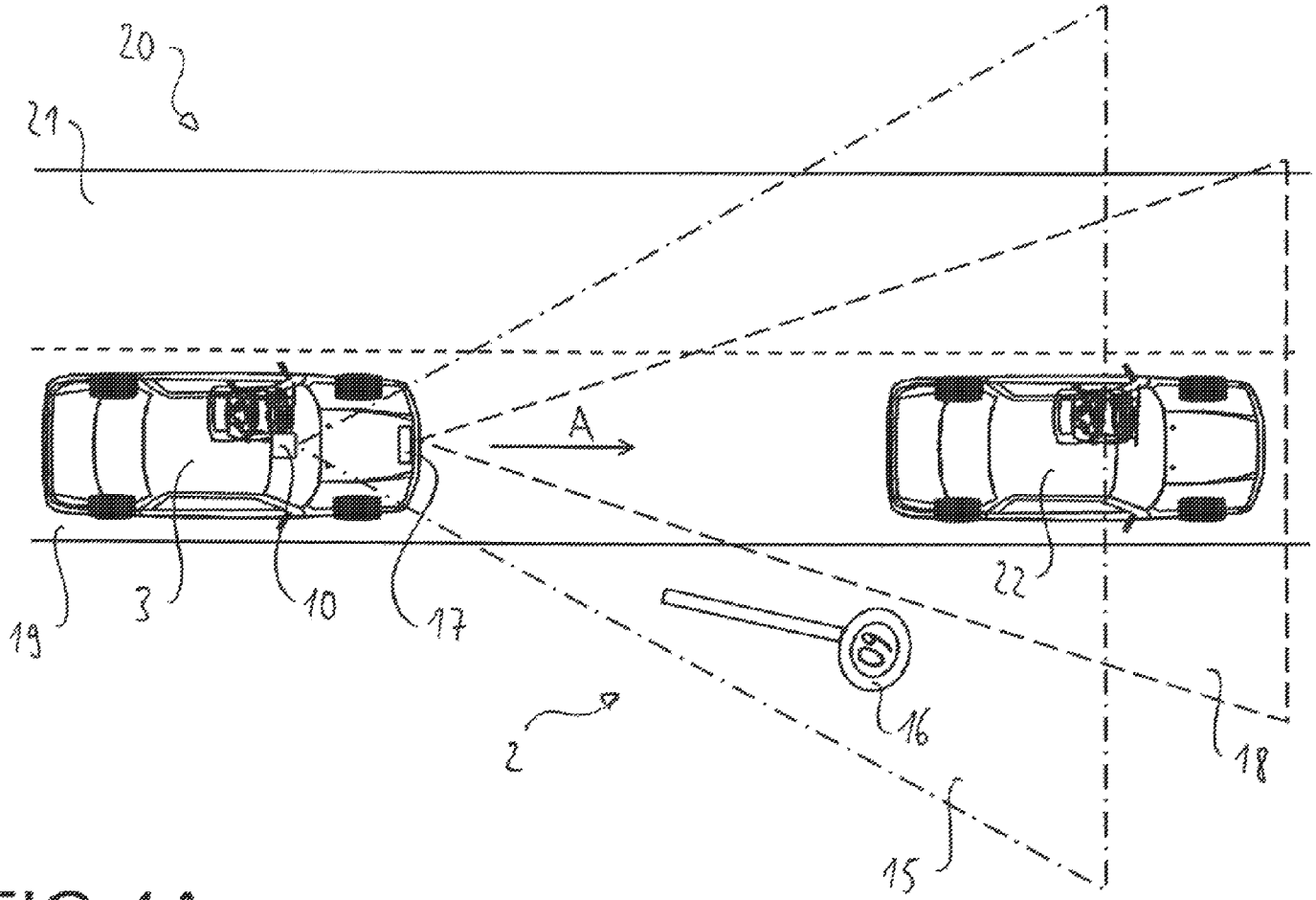
FIG. 4A shows an example of a traffic situation in which a method, which is carried out by means of a computer unit, can be employed.

FIG. 4A shows an example of a traffic situation in which a method, which is carried out by means of a computer unit, can be employed, in particular the methods explained in connection with the FIGS. 1 to 3.

In the shown traffic situation, a vehicle 3 in the form of a passenger car travels on a first lane 19 of a road 20 in a driving direction that is schematically indicated by means of an arrow A. In addition to the first lane 19, the road 20 additionally has a further lane 21.

The vehicle 3 comprises a first sensor 10, wherein the first sensor 10 in the shown situation is designed as an optical camera. The first sensor 10 in this case is designed for sensing objects within a sensing range 15 schematically represented by means of a dash-dotted line. A traffic sign 16, which indicates a value of a speed limit that is applicable in a region of current surroundings 2 of the vehicle 3, is located at least partially within the sensing range 15. By means of this the value of the applicable speed restriction can be determined based on data determined by the first sensor 10. Furthermore, it can be determined based on data determined by the first sensor 10 if no overtaking applies in a region of the current surroundings 2 of the vehicle 3, for example by evaluating road or lane markings sensed by means of the first sensor 10 or a corresponding traffic sign indicating no overtaking.

The vehicle 3 additionally comprises at least one further sensor 17, which is designed for sensing objects within a sensing range 18 schematically shown by means of an interrupted line. Here, the at least one further sensor 17 is selected from the group consisting of a radar sensor, a lidar sensor and an ultrasound sensor.

In the shown traffic situation, a further vehicle 22 in the form of a passenger car travels on the first lane 19 in travelling direction of the vehicle 3 in front of the latter. The further vehicle 22 in this case is located at least partially within the sensing range 18 of the at least one further sensor 17. Based on data determined by the at least one further sensor 17 in particular a position and a distance of the vehicle 3 relative to the further vehicle 22 can be determined in particular. By means of this it can be determined in particular if a minimum distance command of the vehicle 3 to the further vehicle 22 is maintained. Furthermore, the side on which the vehicle 3 overtakes the further vehicle 22 during an overtaking operation and if applicable traffic regulations are adhered to in the process can be determined.

As was already explained in more detail in connection with FIG. 5, traffic regulations which are applicable in a region of the current surroundings 2 of the vehicle 3 can be determined in particular by means of the first sensor 10 and the at least one further sensor 17 and it can be determined in addition if a driver of the vehicle 3 violates any traffic regulations.

Figure 4B:
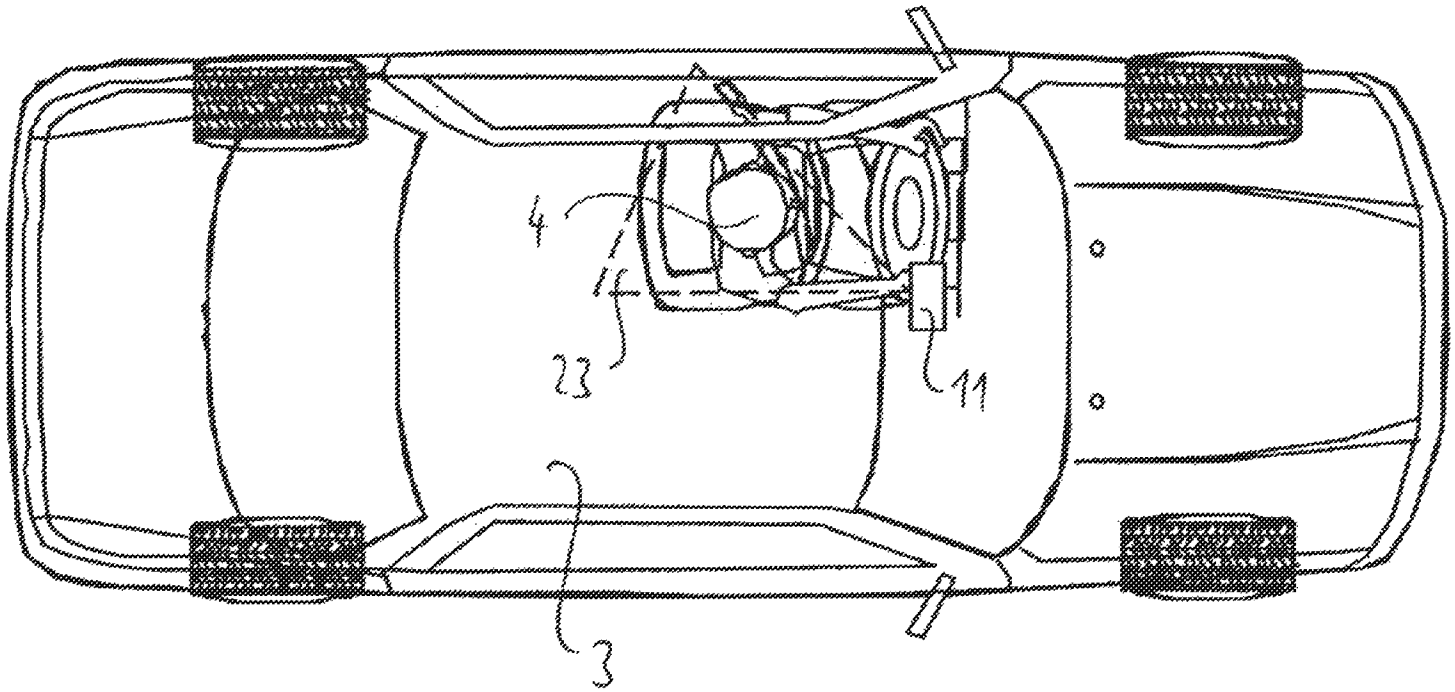
FIG. 4B shows further components of the vehicle shown in FIG. 4A.

FIG. 4B shows further components of the vehicle 3 shown in FIG. 4A. In FIG. 4B, a roof of the vehicle 3 has been partly omitted in order to show the interior of the vehicle 3 in more detail.

In addition to the components shown in FIG. 4A, the vehicle 3 comprises a second sensor 11, wherein the second sensor 11 is designed as an optical camera. The second sensor 11 in this case is designed for sensing objects within a sensing range 23 which is schematically represented by means of an interrupted line. A driver 4 of the vehicle 3 is located at least partly within the sensing range 23. By means of this it can be determined in particular if the driver 4 during a lane change, for example during an overtaking operation, looks over his shoulder.

As is explained in more detail in connection with the following figure, it can thus be determined in particular by means of the second sensor 11 if the driver 4 of the vehicle 3 violates any traffic regulations.

Figure 5:
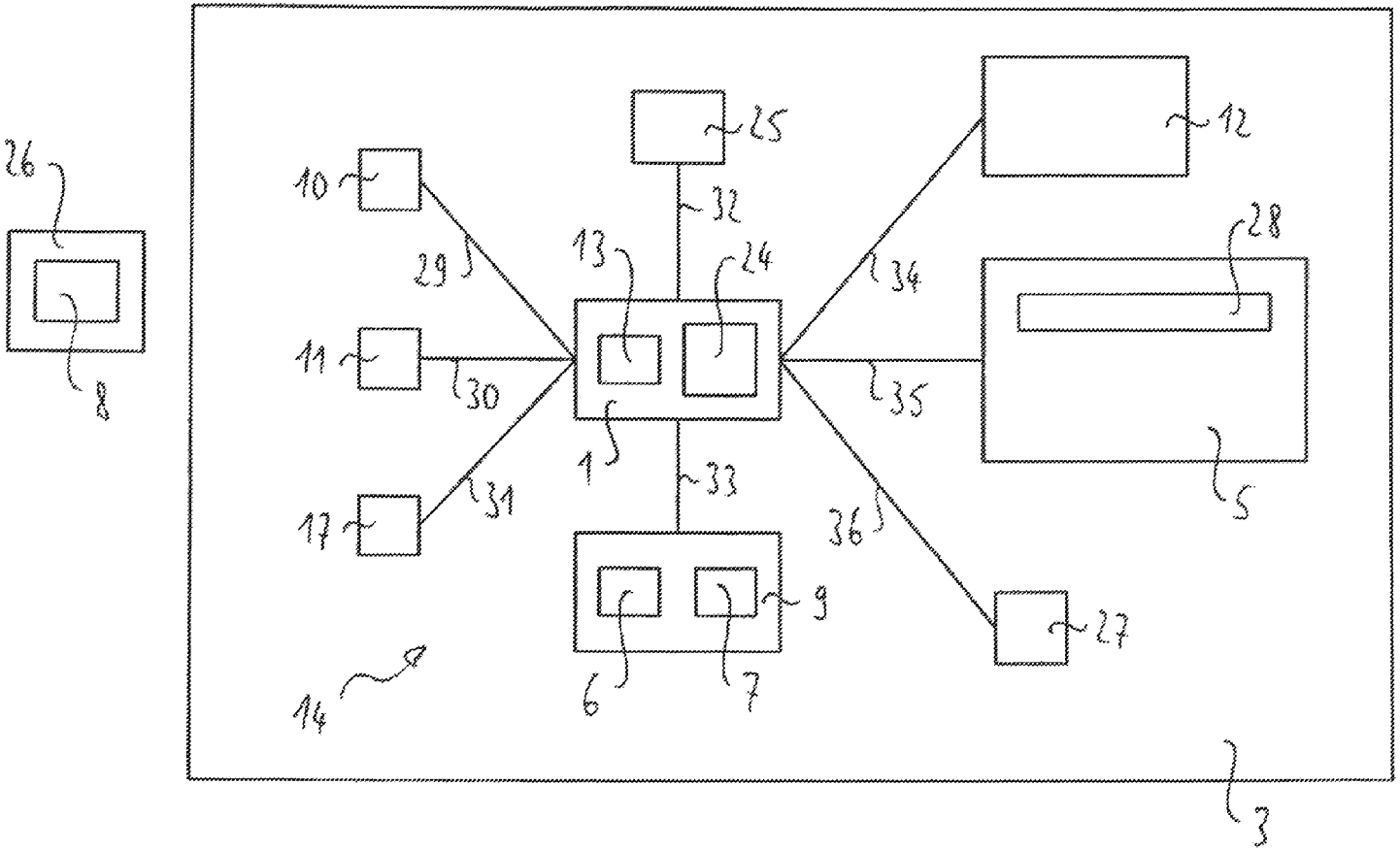
FIG. 5 shows a driver assistance system of the vehicle shown in FIGS. 4A and 4B according to an embodiment of the invention.

In this regard, FIG. 5 shows a driver assistance system 14 of the vehicle 3 shown in the FIGS. 4A and 4B according to an embodiment of the invention. Components with the same functions as in the preceding FIGS. are marked with the same reference characters and are not explained again in the following. For the sake of clarity, the vehicle 3 is merely shown schematically in FIG. 5.

The driver assistance system 14 in the shown embodiment comprises a computer unit 1 in addition to the sensors 10, 11 and 17 shown in the FIGS. 4A and 4B. The computer unit 1 comprises a computer-readable medium 13 and a processing unit 24. The processing unit 24 can for example be designed as an electronic processor, in particular as a microprocessor, microcontroller or application-specifically integrated circuit (ASIC). The computer-readable medium 13 can for example be designed as flash memories. On the computer-readable medium 13 a computer program product according to one of the embodiments mentioned above is stored which, when it is executed on the computer unit 1, instructs the computer unit 1 to carry out the steps explained in connection with the abovementioned embodiments.

To this end, the computer unit 1 is connected to the first sensor 10 via a signal line 29, to the second sensor 11 via a signal line 30 and to the further sensor 17 via a signal line 21.

Furthermore, the computer unit 1 is connected to a navigation system 9 of the vehicle 3 via a signal line 33. By means of this a current position of the vehicle 3 can be determined by means of a position determining device 6 of the navigation system 9. In addition to this, data stored in a storage device 7 of the navigation system 9 regarding traffic regulations which are applicable in a region of the determined current position of the vehicle 3 can be accessed.

In addition, the computer unit 1 is connected to at least one communication unit 25 of the vehicle 3 via a signal line 32, which can in particular comprise a mobile radio communication unit, a vehicle-to-vehicle communication unit and/or a vehicle-to-infrastructure communication unit. By means of this, data regarding traffic regulations which are applicable in a region of the determined current position of the vehicle 3 can be accessed.

The vehicle-external storage device 8 is for example part of a server 26, a roadside infrastructure device, which is also called RSU (RSU, roadside unit) or of a further vehicle.

Furthermore, the at least one communication unit 25 of the vehicle 3 can comprise a radio receiver unit, by means of which based on data received from the radio receiver unit traffic regulations which are likewise applicable in a region of the current surroundings of the vehicle 3 can be determined, for example based on TMC-data (TMC, traffic message channel), provided by broadcasting stations.

The computer unit 1 furthermore is connected to at least one output device 5 of the vehicle via a signal line 35. The at least one output device 5 is designed for outputting a message within the vehicle 3, wherein the message contains a parameter which is determined based on a classified degree of severity of a violation of a traffic regulation characterizing a driving behavior of the driver of the vehicle 3. The at least one output device 5 to this end is designed in the shown embodiment as a visual output device, wherein the parameter is output on scale 28 of the output device 5. In particular, the output device 5 can be designed as an indicating device of an information and entertainment system or an instrument cluster of the vehicle 3. In addition to this, the output device 5 in a further configuration can be designed as an acoustic output device.

Furthermore, the computer unit 1 is connected to a control unit 27 of a drive engine of the vehicle 3 which is not shown in more detail via a signal line 36. By means of this, in the case that the frequency with which the driver of the vehicle 3 violates determined traffic regulations exceeds a first predetermined threshold value, a limitation of a current power consumption of the drive engine of the vehicle 3 and/or of a current speed of the vehicle 3 can be effected.

Furthermore, the computer unit 1 is connected to at least one further driver assistance system 12 of the vehicle 3 via a signal line 34. By means of this, if the frequency with which the driver of the vehicle 3 violates a certain type of traffic regulation exceeds a predetermined threshold value, adapting of at least one operating parameter of the at least one further driver assistance system 12 of the vehicle 3 can be effected. For example, a triggering threshold of the at least one further driver assistance system 12 is adapted when the predetermined threshold value is exceeded in such a manner that the driver assistance system 12 outputs a warning message or performs an autonomous intervention in the driving dynamics of the vehicle 3 at an earlier time.

Although at least one exemplary embodiment was shown in the preceding description, various changes and modifications can be made. The mentioned embodiments are merely examples and are not intended to restrict the scope of validity, the applicability or the configuration in any way whatsoever. The preceding description rather provides the person skilled in the art with a plan for implementing at least one exemplary embodiment, wherein numerous changes in the function and the arrangement of elements described in an exemplary embodiment can be made without leaving the scope of protection of the attached claims and their legal equivalent.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A non-transitory computer readable medium storing a computer program causing a computer to execute a process comprising:

determining traffic regulations which are applicable in a region of current surroundings of a vehicle;

determining if a driver of the vehicle violates at least one of the determined traffic regulations;

wherein, in response to the driver of the vehicle violating at least one of the determined traffic regulations:

determining a frequency with which the driver of the vehicle violates determined traffic regulations;

determining if the determined frequency exceeds a first predetermined threshold value; and limiting at least one of a current power consumption of a drive engine of the vehicle and a current speed of the vehicle in response to the determined frequency exceeding the first predetermined threshold value, classifying a degree of severity of a violation based on a plurality of predetermined degrees of severity in response to a determination that the driver of the vehicle violates at least one of the determined traffic regulations;

determining a parameter illustrating a driving behavior of the driver of the vehicle based on the classified degree of severity of the violation; and outputting a message including the determined parameter with at least one output device.

2. The non-transitory computer readable medium according to claim 1, wherein determining the traffic regulations which are applicable in a region of the current surroundings of the vehicle comprises:

determining a current position of the vehicle with a position determining device; and accessing data stored in a storage device regarding traffic regulations which are applicable in a region of the determined current position of the vehicle.

3. The non-transitory computer readable medium according to claim 2, wherein accessing the data stored in the storage device comprises accessing data stored in at least one of a storage device external to the vehicle and a navigation system.

4. The non-transitory computer readable medium according to claim 1, wherein determining the traffic regulations which are applicable in a region of the current surroundings of the vehicle comprises determining traffic regulations which are applicable in a region of the current surroundings of the vehicle based on data determined by at least one first sensor of the vehicle.

5. The non-transitory computer readable medium according to claim 1, wherein determining the traffic regulations which are applicable in a region of the current surroundings of the vehicle comprises determining of traffic regulations which are applicable in a region of the current surroundings of the vehicle based on data received from at least one communication unit of the vehicle.

6. The non-transitory computer readable medium according to claim 1, wherein determining the traffic regulations which are applicable in a region of the current surroundings of the vehicle comprises determining country-specific traffic regulations which are applicable in the region of the current surroundings of the vehicle.

7. The non-transitory computer readable medium according to claim 1, wherein determining if the driver of the vehicle violates at least one of the determined traffic regulations takes place based on data determined by at least one second sensor of the vehicle.

8. The non-transitory computer readable medium according to claim 1, wherein determining if the driver of the vehicle violates at least one of the determined traffic regulations comprises determining if the driver of the vehicle violates at least one of a speed limit, a right of way situation, no overtaking, and a minimum distance command to a further vehicle.

9. The non-transitory computer readable medium according to claim 1, wherein the process further comprises:

determining if there is a user request for outputting a parameter illustrating the driving behavior of the driver; and outputting a message including the parameter with at least one output device in response to the user request for outputting the parameter.

10. The non-transitory computer readable medium according to claim 1, wherein, in response to the driver of the vehicle violating at least one of the determined traffic regulations, the process further comprises:

determining a type of traffic regulation which the driver of the vehicle violates, based on a plurality of predetermined types of traffic regulations; and determining a frequency with which the driver of the vehicle violates the determined type of traffic regulation.

11. The non-transitory computer readable medium according to claim 10, wherein the process further comprises:

determining if the determined frequency exceeds a second predetermined threshold value; and outputting a message including at least one of the type of the traffic regulation and the determined frequency with at least one output device in response to the determined frequency exceeding the second predetermined threshold value.

12. The non-transitory computer readable medium according to claim 10, wherein the process further comprises:

determining if the determined frequency exceeds a third predetermined threshold value; and adapting at least one operating parameter of at least one driver assistance system of the vehicle in response to the determined frequency exceeding the third predetermined threshold value.

13. A driver assistance system for a vehicle, comprising at least one output device; and a computer unit in communication with said at least one output device configured to execute a process comprising:

determining traffic regulations which are applicable in a region of a current surroundings of a vehicle, determining if a driver of the vehicle violates at least one of the determined traffic regulations, wherein, in response to the driver of the vehicle violating at least one of the determined traffic regulations:

determining a frequency with which the driver of the vehicle violates determined traffic regulations;

determining if the determined frequency exceeds a first predetermined threshold value; and limiting at least one of a current power consumption of a drive engine of the vehicle and a current speed of the vehicle in response to the determined frequency exceeding the first predetermined threshold value, classifying a degree of severity of a violation based on a plurality of predetermined degrees of severity in response to a determination that the driver of the vehicle violates at least one of the determined traffic regulations, determining a parameter illustrating a driving behavior of the driver of the vehicle based on the classified degree of severity of the violation, and outputting a message including the determined parameter with said at least one output device.

14. A method implemented on a computing unit, comprising:

determining traffic regulations which are applicable in a region of a current surroundings of a vehicle;

determining if a driver of the vehicle violates at least one of the determined traffic regulations;

wherein, in response to the driver of the vehicle violating at least one of the determined traffic regulations:

determining a type of traffic regulation which the driver of the vehicle violates, based on a plurality of predetermined types of traffic regulations; and determining a frequency with which the driver of the vehicle violates the determined type of traffic regulation, classifying a degree of severity of a violation based on a plurality of predetermined degrees of severity in response to a determination that the driver of the vehicle violates at least one of the determined traffic regulations;

determining a parameter illustrating a driving behavior of the driver of the vehicle based on the classified degree of severity of the violation; and outputting a message including the determined parameter with at least one output device.

15. The method according to claim 14, wherein determining the traffic regulations which are applicable in a region of the current surroundings of the vehicle comprises:

determining a current position of the vehicle with a position determining device; and accessing data stored in a storage device regarding traffic regulations which are applicable in a region of the determined current position of the vehicle.

16. The method according to claim 15, wherein accessing the data stored in the storage device comprises accessing data stored in at least one of a storage device external to the vehicle and a navigation system.

* * * * *